US006312085B1

(12) United States Patent
Kappel et al.

(10) Patent No.: US 6,312,085 B1
(45) Date of Patent: Nov. 6, 2001

(54) INK JET PRINTING HEAD WITH ELEMENTS MADE OF ORGANOSILICIC COMPOUNDS

(75) Inventors: Jürgen Kappel, Margetshöchheim; Michael Popall, Würzburg; Jochen Schulz, Veitshöchheim; Adelheid Martin, Wittighausen; Birke-E. Olsowski, Veitshöchheim; Karl Bühler, München, all of (DE)

(73) Assignee: Pelikan Produktions AG, Egg/ZH (CH)

( * ) Notice: Subject to any disclaimer, the term of this patent is extended or adjusted under 35 U.S.C. 154(b) by 0 days.

(21) Appl. No.: 09/029,350

(22) PCT Filed: Jun. 26, 1997

(86) PCT No.: PCT/DE97/01340

§ 371 Date: Jul. 13, 1998

§ 102(e) Date: Jul. 13, 1998

(87) PCT Pub. No.: WO98/00296

PCT Pub. Date: Jan. 8, 1998

(51) Int. Cl.[7] ..... B41J 2/015

(52) U.S. Cl. ..... 347/20; 347/67; 347/45; 427/240

(58) Field of Search ..... 347/67, 20, 45; 427/240; 430/253; 562/850

(56) References Cited

U.S. PATENT DOCUMENTS 4,175,145 * 11/1979 Fechter ..... 427/240
4,499,176 * 2/1985 Curtis et al. ..... 430/253
4,639,748 * 1/1987 Drake et al. ..... 347/67
4,647,413 * 3/1987 Savu ..... 260/544
6,010,757 * 1/2000 Yamamoto et al. ..... 428/413

FOREIGN PATENT DOCUMENTS 44 00 315 C1 1/1995 (DE) .
196 13 650 C1 4/1997 (DE) .
0 658 430 A1 6/1995 (EP) .
0 734 866 A2 10/1996 (EP) .
WO 96/06895 * 3/1996 (EP) ..... B41J/2/16

OTHER PUBLICATIONS

Patent Abstract of Japan, vol. 096, No. 011, Abstract of JP 08 174845 A (Canon, Inc.) Jul. 9, 1996.

Patent Abstract of Japan, vol. 008, No. 080, M–289, Abstract of JP 58 224761 A (Canon Inc.) Dec. 27, 1983.

Database Inspec., Institute of Electrical Engineers, Inspec. No. AN 5683949, XP002044420.

* cited by examiner

*Primary Examiner*—John E. Barlow, Jr.
*Assistant Examiner*—M S Shah
(74) *Attorney, Agent, or Firm*—Fay, Sharpe, Fagan, Minnich & McKee, LLP

(57) ABSTRACT

The invention provides inkjet print heads, which have one or more components of a polymer material, which is produced, substantially, or with the use of, at least one Compound (I) $X_aR_bSiR^1_{(4-a-b)}$ with X=hydrolyzable group, R=eventually substituted Alkyl, Aryl, Alkenyl, Alkylaryl or Arylalkyl, $R^1$=organic remainder with at least one polymerizable group, a= to 3, b=0 to 2. In addition, the invention provides a process for the manufacture of the heads and for the utilization, for said purpose, of a polymer material.

12 Claims, 5 Drawing Sheets

REM PHOTOS OF THE STRUCTURIZED GMP2T SYSTEM, EXPOSURE TIME: 10 SECONDS

Figure 1:
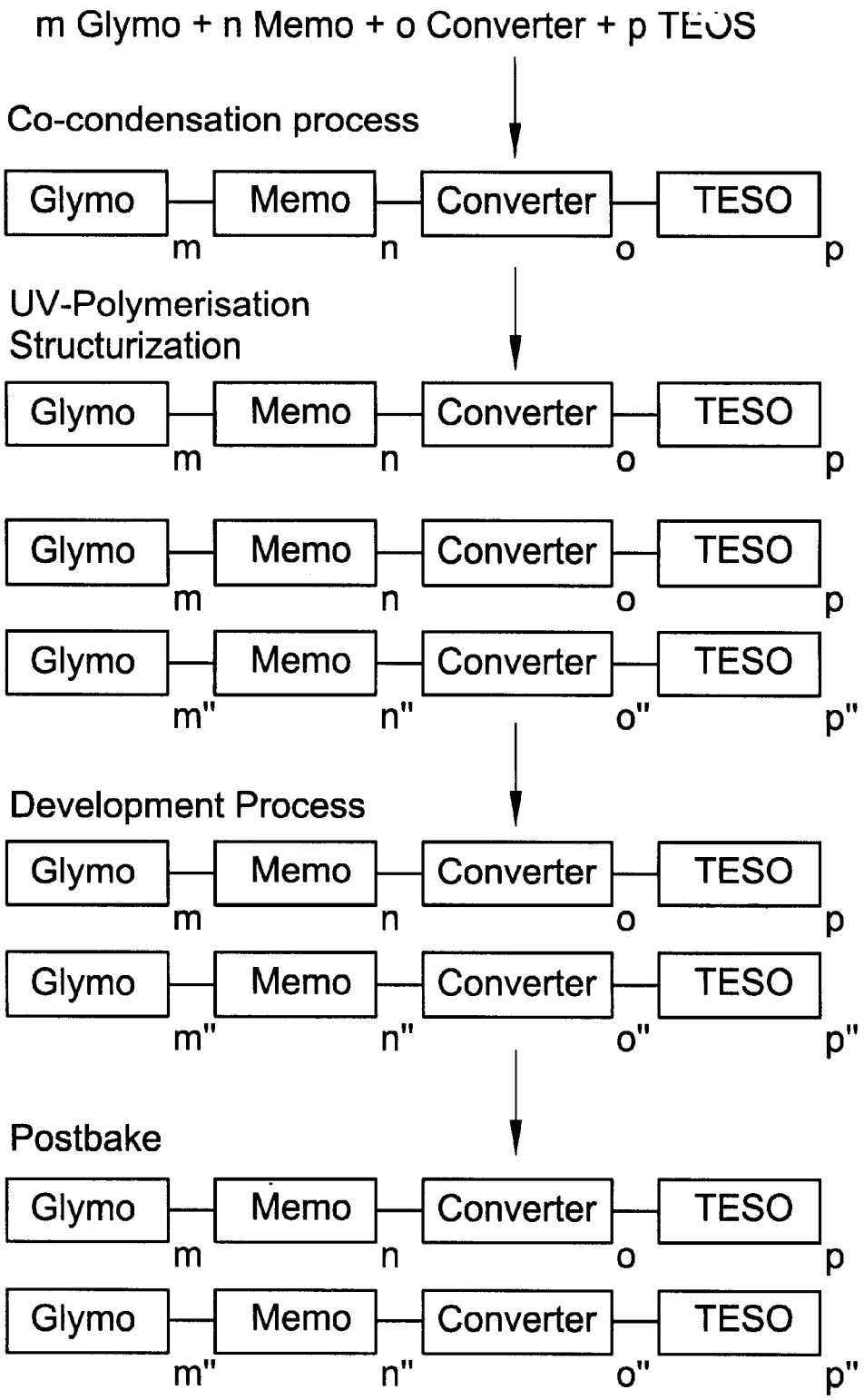

HEIGHT - DEPTH PROFILE OF THE GMP2T SYSTEM,
EXPOSURE TIME: 10 SECONDS

HEIGHT - DEPTH PROFILE OF THE GMP2T SYSTEM STRUCTURIZED BY DIRECT LASER WRITING

INK JET PRINTING HEAD WITH ELEMENTS MADE OF ORGANOSILICIC COMPOUNDS

The present invention concerns inkjet print heads which consist, at least in part, of a polymer material which is produced with the use of silicon-organic compounds with polycondensable and polymerizable groups.

At the present time, inkjet print heads must be manufactured in ever increasing numbers. On the one hand, this printing technique has, in the meantime, found enormous application and, secondly, it is desirable to develop an inexpensive print head, which can, each time, be exchanged together with the ink cartridge.

Ink jet print heads consist—in addition to the actor, i.e. (heating element, piezo element, electro-dynamic converter etc.)—of structures for fluid transport (channel walls, channel coverings, jet walls, jet coverings, ink supply) ink filters and a non-wetting jet exit side (for example jet plate). Modern inkjet print head have in common planar construction, which facilitates by means of semiconductor production, a relatively cost-effective, highly accurate manufacture in large quantities. There are differences in construction: in the so-called "edge-shooter arrangement" the droplet expulsion occurs tangentially vis-a-vis the heating element surface, while in the so-called "side-shooter arrangement" the droplet is emitted normally relative to the heating element surface.

The layered construction of the "edge shooter variation" (substrate, thin film structure, channel structure, channel covering, glass tub with ink reservoir) requires jets which are formed by different materials with varying wetting properties (thin-film layer, photoresists channel wall, photoresists adhesive layer, channel covering). These varying wetting properties have a negative effect upon the droplet formation. Therefore, with "edge shooter arrangements" there exists the additional requirement of coating the jet exit surface with a hydrophobe material.

In contrast, the jet exit of the side shooter arrangement jet plate consists of only one material. Consequently, identical wetting properties exist in the jet area. An additional coating ("Antitriel"-coating) is needed only if the hydrophobic properties of the material are insufficient.

Normally, the channel structures of present-day print head are produced from photoresists on acrylate basis by means of photolithographic processes. Forturan glass is employed, for example, which is structurally corrodible following mask exposure.

It is the object of the present invention to make available a universally employable material for inkjet print heads with which it is possible to completely produce channel structures, substrates, jet plates, jets, ink reservoirs, ink filters and similar for color and single color inkjet print heads, and whose hydrophobe properties suffice in order to forego the application of an "Anti-Wetting"-Coating. The material shall be cost-effective and structuring shall be effected with little expenditure and/or high precision.

Said object is solved by providing a polymer material for inkjet print heads which is basically produced from, or with utilization of, at least one compound I $$X_aR_bSiR^1_{(4-a-b)} \qquad \text{I}$$

| | | |
|---|---|---|
| with X | = | hydrolyzable group |
| R | = | if required, substituted alkyl, aryl, alkenyl, alkylaryl or arylalkyl, |
| R' | = | organic remainder with at least one polymerizable Group |
| a | = | 1 to 3 |
| b | = | 0 to 2. |

It could hereby be discovered that the manufacture of channel structures can be effected with the aid of technically or physically different processes, so that depending upon the individual requirements as to quality and price, particularly cost-effective heads can be produced as so-called "disposable" heads, while with a somewhat more costly process print heads of particularly high quality can be produced, which provide longer service life or are suitable for greater ink through-put.

Polymer materials of the type employed according to the invention are part of the material category of the so-called ORMOCERS (ORganically MOdified CERamics). They may be classified among the inorganic and organic polymers. Production takes place based on alkoxides of silicon and, if needed, supplementary to other metals which have been modified, totally or partially, by organically polymerizable substituents. By means of hydrolysis and condensation, the inorganic part of the network is formed by means of polymerization, polyaddition or other organic coupling reactions, the organic part from reactive organic substituents.

By targeted incorporation of photo-interlinkable organic groups and components, it is possible to produce the aforementioned ORMOCERS for photolitographical and other relevant applications. Preferably, 4-component systems are involved, which can be specifically modified and adapted to the specification profile for micro-electronic, micro-optical and micro-mechanical requirements.

Layers which are to be structured can be produced as follows according to the invention: To begin with, within a polycondensation reaction (for example in the Sol-Gel Process) a pre-condensate (mostly called "lacquer" in this text) is produced from the chosen educts, which depending upon the employed chemical compounds, usually has a storage stability of several months. The lacquer can be varied in its solid matter contents, for example by draining of solvents or water or also by addition of another solvent. The lacquer is subsequently applied to the desired substrate material in form of a layer by immersion, hurling or spraying, whereby the substrate may not only consist of foreign material such as glass, ceramic, metal or extraneous polymer, but also of the identical material. By exposure of structure (mostly UV light) the lacquer can be photopolymerized with any chosen technology at the desired locations, whereby, by means of a so-called "developmental step" the non-exposed part is leached out (negative-resist-behavior), which can be done with the aid of solvents such as acetone or alkaline watery medium. In conclusion, the already structured material is completely interlaced. Mechanical pressing is also possible with simultaneous or subsequent exposure and succeeding thermal post-interlacing.

Thus, is preferred that the polymer material contain both photopolymerizable groups as well as thermally interlinkable groups. In addition, of course, a photoinitiator and, if needed, an accelerator, for example, an amine base, is added.

An example of the development of a polymer "ORMOCER"-Hybrid material is shown in FIG. 1.

To begin with, by polycondensation of alkoxysilanes, the inorganic oxide network is first constructed—in a subsequent step, the mathacryl groups of the 3-methacryloxyproplytrimethoxysilane (MEMO) are photochemically interlaced and finally the epoxy groups of 3-Glycidoxypropyltrimethoxysilane (GLYMO) are thermally polymerized, so that an organic network is created.

The following systems are proving themselves as particularly suitable for the manufacture of the polymer material.

GMP2T, GMDT, GMP2D and GMD, with

| | | |
|---|---|---|
| G | = | Glycidoxypropyltrimethoxysilane, |
| P2 | = | Diphenylsilandiol |
| M | = | Methacryloxypropyltrimethoxysilane, |
| T | = | Tetraethoxysilane and |
| D | = | Dimethyldimethoxysilane. |

Suitable photochemical radical starters are for example Quantacure ITX by Shell Chemie, Irgacure 184 by Ciba-Geigy or Darocur 4263 by Messrs. Merck. Suitable as accelerator for the photo-chemical interlacing is, for example N-Methyidiethanolamine or Diethylenetriamine, whereby the latter can as well function as epoxide hardener.

Mixtures of these can also be employed.

Employment of the GMP2T System is particularly preferred.

The lacquer is preferably produced in that the desired silanes are, if needed, mixed with additional additives (for example network builders or modifying substances) and, if necessary, hydrolyzed under heat, by adding water. Addition of water may be done slowly, so that the system is initially supplied with sub-stoichiometric amounts.

The liquid lacquer, manufactured as described above, is brought, if needed, to a desired solid matter contents, which is preferably done by rotary incorporation or distillation of solvents or water. When required, dilution with an appropriate solvent may be done in addition or alternatively (for example dilution with ethanol, acetone, propylacetate or similar). A solid matter contents in the range from 50% to 85%, specifically of approximately 75% is desirable. It should, however, be clear that, depending upon the type of application and the desired structure height, one may also operate with other solid matter contents.

The lacquer can then be applied in form of a layer on one or different substrate(s). With respect to the substrate(s) it or these may be of another material such as glass, ceramic, silicon or polymer, but an application can also be applied of material according to the invention, which should then have already been finish-hardened. The lacquer may be applied via "spin-on" application (for example at a turning speed of approximately 300 to 800 revolutions per minute and for a time period of approximately 30 to 80 s. Of course, other application possibilities also exist, such as, for example, by blade coating, immersion, spraying, pressing and others.

Subsequently the lacquer is subjected to structuring in order to produce channels or comparable structures. Principally, this can be done according to any selected process, whereby, however, preference is given to the processes described below.

1. Photolithography

Photostructuring takes place, in principle, with the aid of exposure of the desired portions of the lacquer, whereby exposure occurs with a two-dimensional light source. The portions of the lacquer which are not to be exposed are protected from exposure to rays with the aid of a mask. The mask may, for example, be arranged in front of the light source. Alternatively, one can work with a mask aligner, whereby, under certain circumstances there may be simultaneous mechanical pressing of the lacquer with the aid of the mask. This, however, is reserved for special cases, since, frequently, a contact exposure might result in sticking together of mask and lacquer. Exposure is done with a wave length that initiates the photochemical reactions in the lacquer.

A suitable composition of the polymer material for the photolithography is the GMP2T System. Specifically with a lacquer from this material, which was substantially freed from the volatile component generated during reaction of components, and was diluted with propylacetate down to the desired solid matter contents, layer thicknesses can be obtained of more than 10 $\mu$m and even in the range of <40 $\mu$m. In addition to GMP2T, GMDT proves itself to be quite suitable, specifically with respect to adhesive properties. GMP2D and specifically GMD have because of their high percentage of only double inorganic interlinkable units a higher elasticity, as a result of which greater structure heights are realizable without fissures. Incorporation of filler substances is possible. It should be noted that a rising percentage of filler substances may reduce adhesion to the substrate.

Following exposure of the desired parts of the lacquer, the photochemically unchanged portions are treated with a solvent ("development"). Polar substances are suitable as solvent, such as watery alkali-solutions, alcohol and similar, but also non-polar solvents, such as Toluol and similar, provided they are capable of dissolving from the layer the non-polymerized condensate. Ethanol, Isopropanol and Acetone have proven themselves as particularly suitable for the GMP2T System.

Subsequently, the obtained structures are thermally after-cured. This can be done, for example, within an hour at a temperature ranging from 100° C. and 170° C.

2. Laser Direct Recording

Coating of the substrates, the development of structures and also the thermal after-cure takes place in laser direct recording the same as in photolithography. It is true, however, that instead of a large two-dimensional light source, a narrowly focussed laser beam is chosen for direct exposure of the lacquer. The laser beam is being focussed on the desired width, for example 3 to 50 $\mu$m and specifically 10 to 20 $\mu$m for the desired channel structures. Recording is done for example at a speed of 0.1 to 10 mm/sec. A speed of roughly 1 mm/sec. is particularly preferred in order to achieve uniform structures, free from fissures. With laser direct recording it is also possible to obtain structure heights up to 40 $\mu$m.

The preceding process should be given preference vis-a-vis photolithography relative to precision, i.e. regarding the rectangular profile of the structures, however, due to the low recording speed, it is significantly more expensive.

3. Impressing Process

The impressing process constitutes another possibility for producing the channel structures. In this case the lacquer is preferably thermally or photochemically pre-interlaced, in order to avoid sticking to the pressing mask. A thermal pre-treatment of a few minutes at approximately 80° C.–120° C. is beneficial. Higher temperatures result in much advance cross-linking (as a result of which penetration of the pressing mask is made more difficult), while shorter thermal pre-treatments will not prevent the sticking together of mask and layer.

For example, structured glass or Si-masks or nickel plates with structural heights in the range of 40 $\mu$m may be employed as masks. Pressing machines according to the type of a mask aligner are possible. Preferably, simultaneously with pressing of the mask there is exposure or thermal treatment at temperatures of up to 170° C. Subsequently tension is again relaxed, the mask is pulled off and the obtained structure thermally after-cured.

With the present process it is possible to produce ink print head components such as channel walls, channel coverings, jet walls, jet coverings, passivation layers jet plates, ink reservoirs, ink filters and similar. To that end, the coated substrates are superposed while the desired channels are being created (base-base, head-head).

If an identical material is used as substrate (base) the ink print head is produced from one uniform material, except for actors for the droplet generation (heating element, piezo element, electro-dynamic converter etc.) The manufacture of planar ink print heads is particularly beneficial according to the invention.

The following contains a more detailed explanation of the invention based on some exemplary embodiments.

EXAMPLE 1

Manufacture of a Coating Lacquer

Basic Compounds:

1. 0.4 mol g-Glycidopropyltrimethoxysilane (=38.6 mol-%)
2. 0.4 mol g-Methacryloxypropyltrimethoxysilane (=38.6 mol-%)
3. 0.2 mol Diphenylsilandiol (=18.9 mol-%)
4. 0.04 mol Tetraethoxysilane (=3.9 mol-%)
5. 2.37 mol water The components 1 to 4 are provided and stirred at room temperature for 18 hours. Subsequently, the suspension is heated, within a time span of 90 minutes, to a temperature of approximately 70° C.

After the suspension has become clarified, ¼ of the amount of water is added, while maintaining the temperature. In intervals of approximately 20 minutes, the remaining amount of water is added (in amounts of ¼ each time). After all the water has been added, stirring continues at 70° C. for one hour. After that, the heat is removed and the lacquer is ready for use after cool-down.

EXAMPLE 2

Photolithographic Manufacture of Channel Structures

Figure 2:
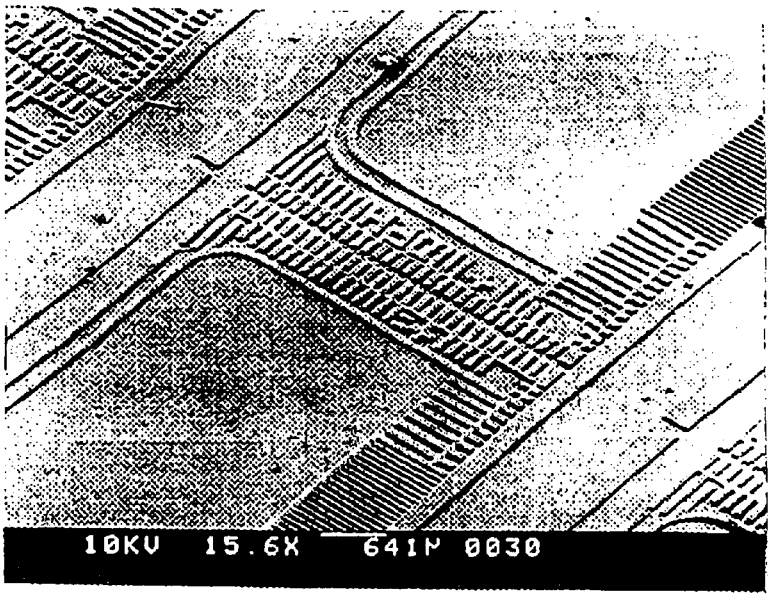
Figure 3:
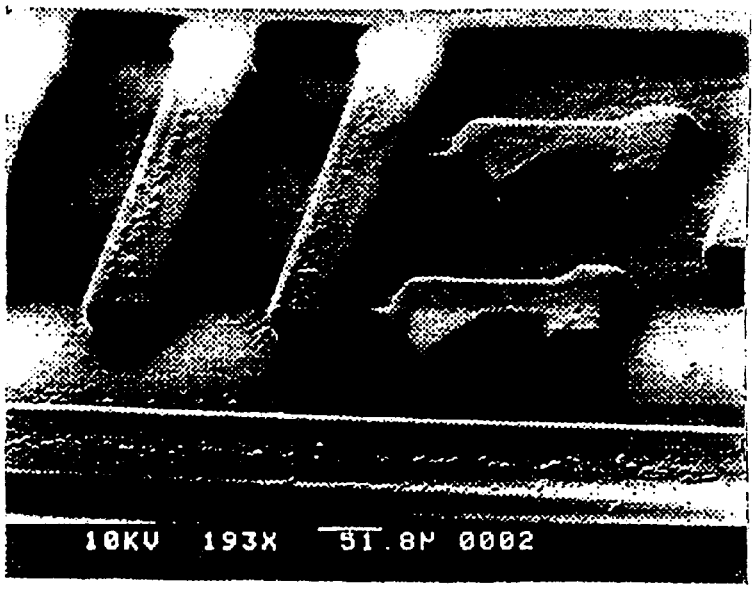
Figure 4:
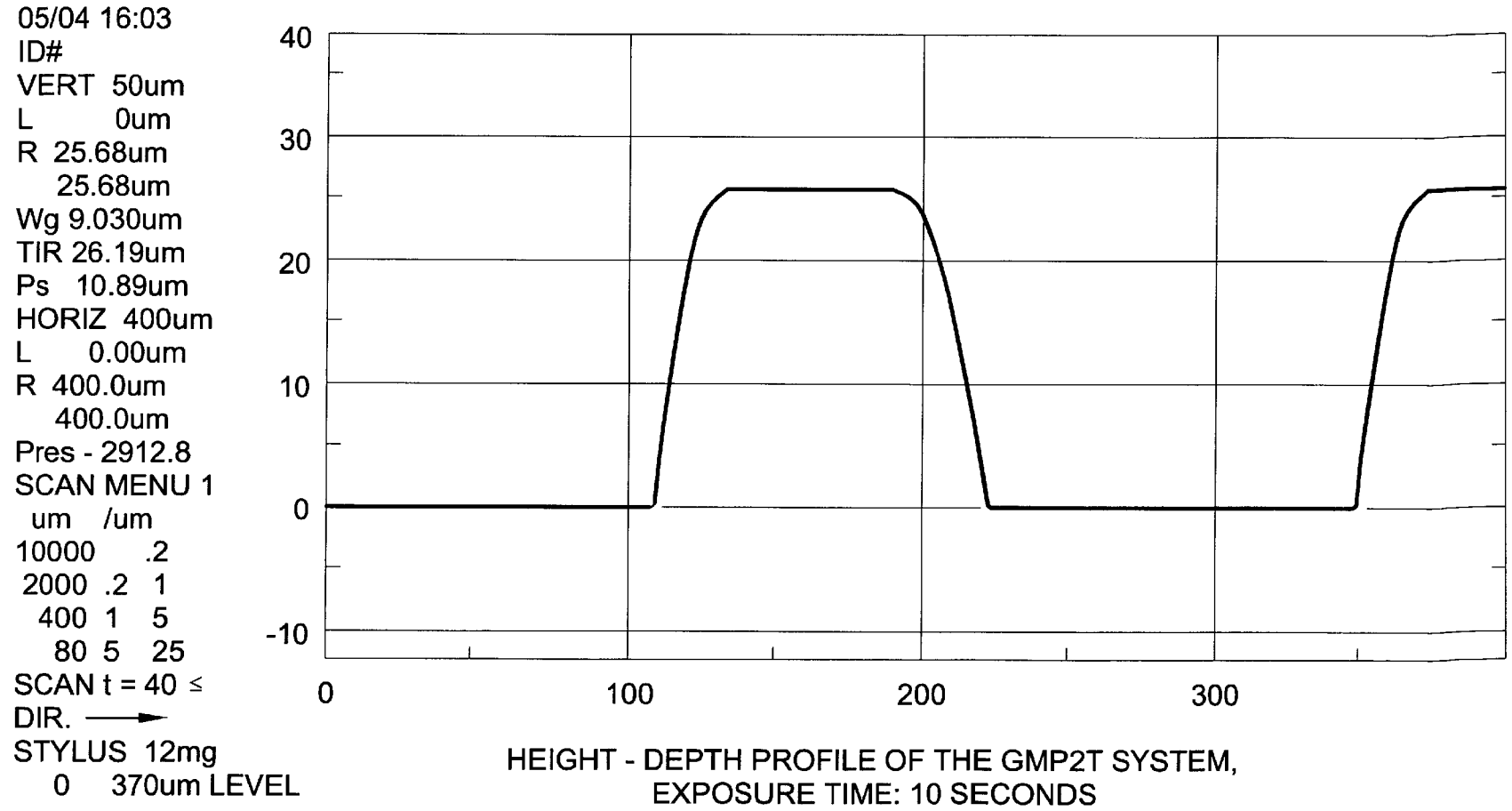

System GMPT2 is employed for manufacturing the channel structures, which demonstrates excellent adhesion relative to the different substrate materials, even after the ink has been stored. In order to preserve great structural heights, the solvent is eliminated by means of distillation until a solid matter contents of 75% is reached. The following ingredients are dissolved in the lacquer 1.5 mass-% photoinitiator (Quantacure ITX, Shell Chemie) and 1.5 mass-% accelerator (N-Methyldiethanolamine and Diethylenetriamine, ration 1:1), and this system is applied to substrate (glass, Si) by means of spin-on mode (600 revolutions per minute for 60 seconds). Photostructuring occurs by means of mask-aligner (Karl-Suess MA45) at a wave length of 360 nm and an exposure intensity of 14 mW/cm$^2$. Under these conditions, optimal exposure times are approximately 10 seconds. The development of exposed structures occurs by means of spray development with ethanol (duration: 10 seconds). The obtained structures are hardened for 10 hours at 120° C. These structures are characterized in FIGS. 2 to 4 (REM and profilometric measurements). With the described process, structural heights, (showing no fissures) of up to 30 $\mu$m can be realized in one step. These structures show high edge steepness, have good substrate adhesion and also the required ink storage stability. For these reasons and based on its temperature stability of up to 270° C. (thermographimetric determination in air) these structures are very well suited as channel structures for ink jet print heads.

EXAMPLE 3

Manufacture of Channel Structure with the Aid of Laser Direct Recording

Figure 5:
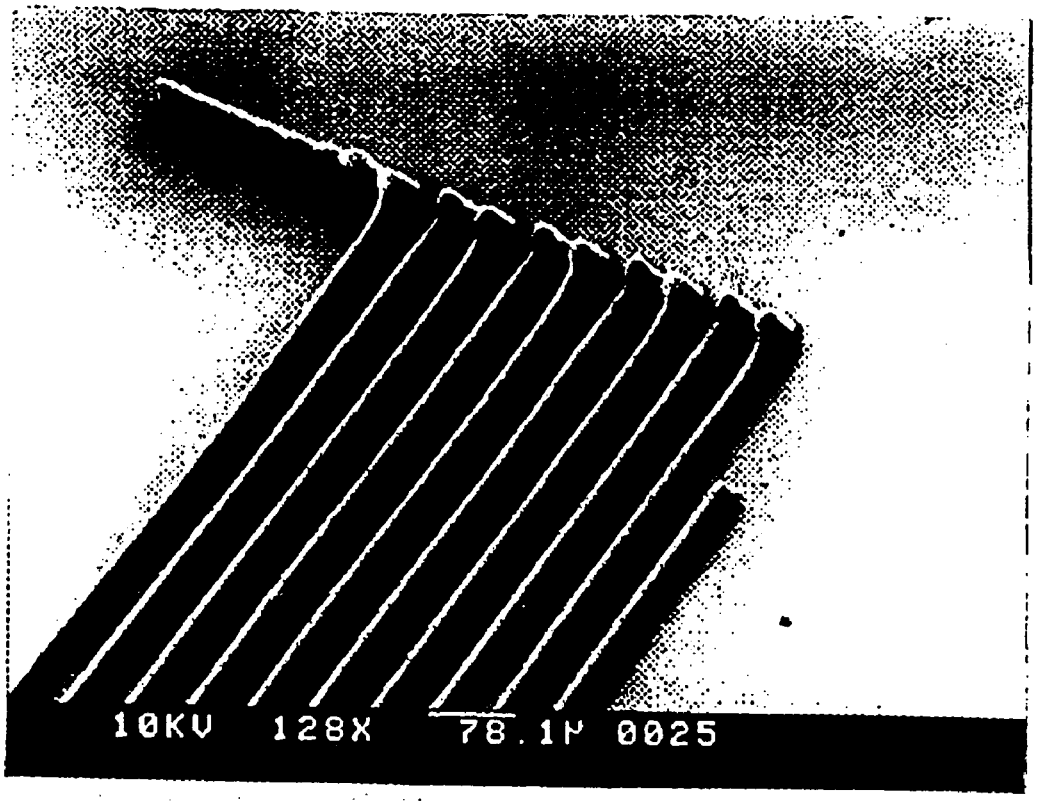
Figure 6:
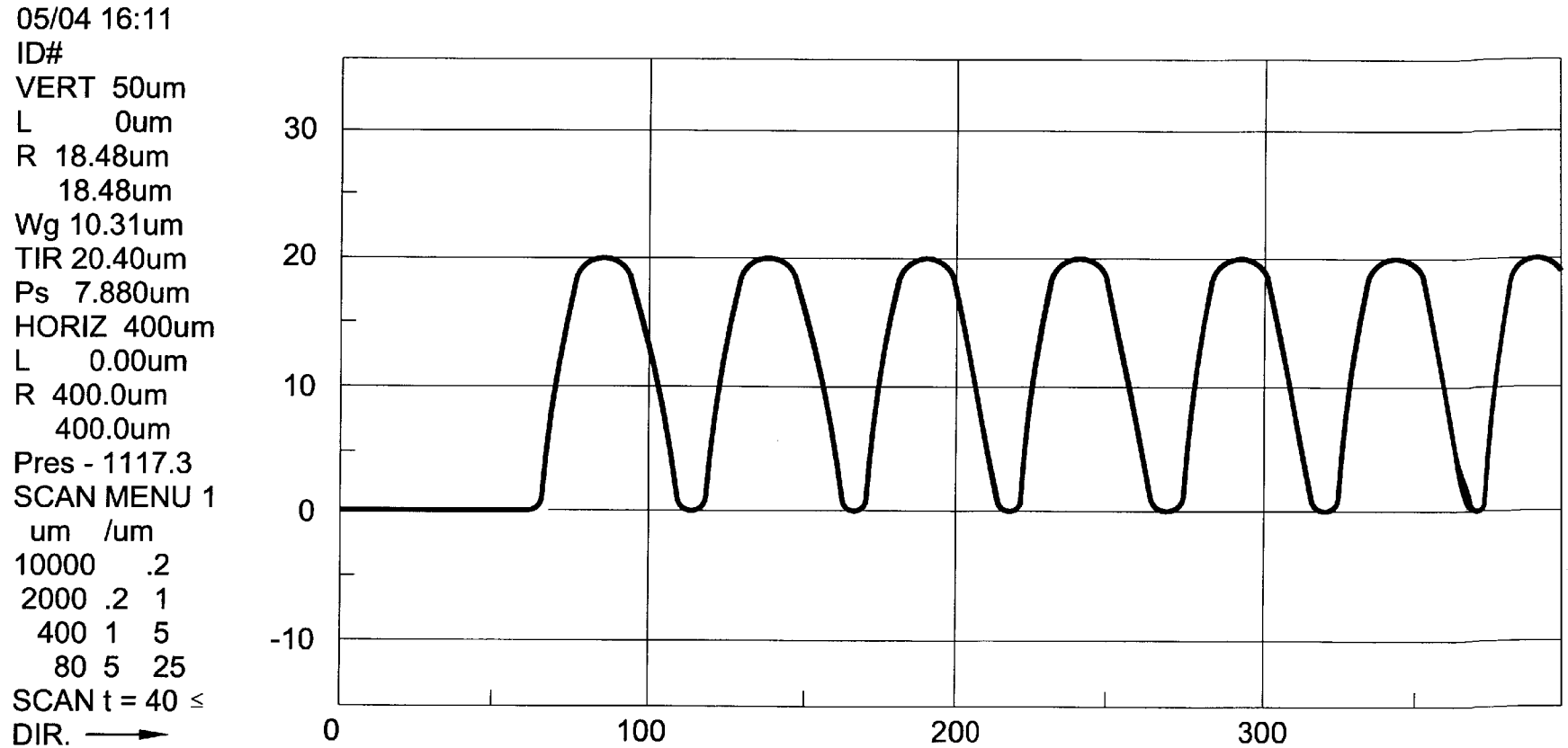

Coating of substrates, development of structures and the thermal after-curing for laser direct recording is done as described in Example 2. System GMPT2 is again selected as material, the concentration of photoinitiator is 0.05% by weight (Irgacure 184, Messrs. Ciba-Geigy or Quantacure ITX), laser wave length lies at 360 nm, laser output prior to focussing is 1.41–2.28 mW (variable; 1 mm beam diameter). The laser beam is focussed on approximately 10 to 15 $\mu$m. Recording is done at a speed of 1 mm/sec. FIGS. 5 and 6 show such laser recorded structuring and also the relevant profilometric measuring. The thickening at the edges is attributable to the paused laser beam when changing directions. Structural height is 20 $\mu$m.

EXAMPLE 4

Pressing Process

For the pressing of channel structures, systems GMP2T is used as well (see example 2). Application conditions (glass substrate) and hardening (photochemical and thermal after-cure) are described in the preceding example. The pressing process requires thermal pre-treatment of the applied coating. Most favorable pre-hardening conditions are thermal pre-treatments at approximately 80° C. (5 minutes). Raising of temperature results in strong pre-interlinking (poor penetration of pressing mask as a result), while shorter thermal pre-treatment leads to mask and layer sticking together. As masks, structured glass or Si-masks with structural heights of up to 40 $\mu$m are utilized. These masks are placed upon the layer after same has been pre-hardened, and pressed onto same with a pressure of approximately 1 kg/cm$^2$, with simultaneous exposure (approximately 10 seconds, 14 mW/cm$^2$ at 360 nm). Subsequently, tension is relaxed, the mask is pulled off and the obtained structure undergoes an after-cure at 120° C. for 10 hours.

Having thus described the invention, we now claim:

1. Inkjet Print Head including at least one component comprised of a polymer material, the material manufactured substantially, or with the use of at least one compound I $$X_aR_bSiR'_{(4-a-b)} \qquad \text{I}$$

with X=hydrolyzable group

R=optionally, substituted alkyl, aryl, alkenyl, alkyaryl or arylalkyl,

R'=organic remainder with at least one polymerizable group, a=1 to 3 b=0 to 2 said compound I containing an optionally substituted vinyloxyalkyl group and an optionally substituted alkylenoxide-oxyalkyl group.

2. Inkjet Print Head according to claim 1, characterized in that the components are chosen among channel structures, substrates, jet plates, jet ink reservoirs and ink filters.

3. Inkjet Print Head according to claim 1, characterized in that for the manufacture, use was made of a compound I containing a group accessible to photopolymerization and a compound I containing a thermally interlinkable group or a compound I containing a group accessible to photopolymerizaton and also a thermally interlinkable group.

4. Inkjet Print Head according to claim 1, whereby the polymer material is manufactured with utilization of Glycidoxypropyltrimethoxysilane, Methacryloxypropyltrimethoxysilane, Diphenylsilandiol or Tetraethoxysilane.

5. Process for the manufacture of an inkjet print head, comprising the steps of manufacturing at least one component of the head with a polymer material, said material including at least one Compound I $$X_aR_bSiR'_{(4-a-b)} \quad \text{I}$$

with X=hydrolyzable group

R=optionally, substituted Alkyl, Aryl, Alkenyl, Alkyalaryl or Arylalkyl,

R'=organic remainder with at least one polymerizable group, a=1 to 3 b=0 to 2 wherein the at least one component is produced by applying a lacquer to a substrate, said lacquer including at least compound I and a photoinitiator and structuring the lacquer by:

exposure of desired parts of the lacquer, wash-out with a solvent of unexposed parts of the lacquer, and thermal after-cure of the formed structures, whereby the polymer material is developed.

6. Process according to claim 5, characterized in that prior to application on the substrates, the lacquer is brought to a solid matter contents of at least 50% by weight.

7. Process according to claim 5, characterized in that the lacquer is applied to the substrates using a Spin-on Process.

8. Process according to claim 5, characterized in that exposure is effected with a two-dimensional light source, whereby those parts of the lacquer which are not to be exposed, are protected from exposure with the aid of a mask.

9. Process according to claim 5, characterized in that exposure is effected with a focused laser beam by Laser Direct Recording.

10. Utilization of a polymer material which is produced from, substantially, or with the utilization of, at least one Compound I, passivation layers, jet plates, ink reservoirs and ink filters $$X_aR_bSiR'_{(4-a-b)} \quad \text{I}$$

with X=hydrolyzable group

R=optionally, substituted Alkyl, Aryl, Alkenyl, Alkyalaryl or Arylalkyl,

R'=organic remainder with at least one polymerizable group, a=1 to 3 b=0 to 2 as material for inkjet print heads or inkjet print head components, wherein Compound I contains an eventually substituted vinyloxyalkyl group and an eventually substituted alkylenoxide-oxyalkyl group.

11. Utilization according to claim 10, characterized in that the inkjet print head components are selected from the group consisting of channel walls, channel coverings, jet walls, jet coverings, passivation layers, jet plates, ink reservoirs, ink filters and combinations thereof.

12. Process for the manufacture of an inkjet print head, characterized in that one or several components(s) of the head is/are manufactured of a polymer material, which is produced with the use of at least one Compound I $$X_aR_bSiR'_{(4-a-b)} \quad \text{I}$$

with X=hydrolyzable group

R=optionally, substituted Alkyl, Aryl, Alkenyl Alkyalaryl or Arylalkyl,

R'=organic remainder with at least one polymerizable group, a=1 to 3 b=0 to 2 or, substantially, from at least one Compound I further comprising that the component(s) are produced in that the material is applied to substrates in form of a lacquer from the pre-condensed basic compound(s), precondensed by addition of water, to which a photoinitiator is added and, optionally, an accelerator, that the lacquer after eventual pre-treatment, is structured and subsequently the substrates are put together so that a three-dimensional structure is created, the structuring of the lacquer is effected with the assistance of the following steps:

eventual thermal or photochemical pre-treatment, mechanical impressing of the desired structures in the lacquer, exposure of at least the non-recessed parts of the lacquer, thermal post-interlinking of the formed structures.

* * * * *